US011092314B2

(12) United States Patent
Maghnagi et al.

(10) Patent No.: US 11,092,314 B2
(45) Date of Patent: Aug. 17, 2021

(54) MOTORIZED RECESSED SPOTLIGHT WITH RACK FOR ROTATION ABOUT A LONGITUDINAL AXIS

(71) Applicant: FORMA LIGHTING ITALIA S.R.L., Milan (IT)

(72) Inventors: Lawrence Maghnagi, Milan (IT); Angelino Tacchi, Milan (IT)

(73) Assignee: FORMA LIGHTING ITALIA S.R.L., Milan (IT)

( * ) Notice: Subject to any disclaimer, the term of this patent is extended or adjusted under 35 U.S.C. 154(b) by 0 days.

(21) Appl. No.: 16/979,991

(22) PCT Filed: Mar. 12, 2019

(86) PCT No.: PCT/IB2019/051974

§ 371 (c)(1),
(2) Date: Sep. 11, 2020

(87) PCT Pub. No.: WO2019/175752

PCT Pub. Date: Sep. 19, 2019

(65) Prior Publication Data

US 2021/0018163 A1 Jan. 21, 2021

(30) Foreign Application Priority Data

Mar. 15, 2018 (IT) ..... 102018000003612

(51) Int. Cl.

| | |
|---|---|
| ***F21V 14/02*** | (2006.01) |
| ***F21S 8/02*** | (2006.01) |
| ***F21V 21/04*** | (2006.01) |
| ***F21V 21/15*** | (2006.01) |
| *F21V 29/77* | (2015.01) |

(52) U.S. Cl.

CPC ..... *F21V 14/02* (2013.01); *F21S 8/026* (2013.01); *F21V 21/04* (2013.01); *F21V 21/15* (2013.01); *F21V 29/773* (2015.01)

(58) Field of Classification Search

CPC ..... F21V 14/02; F21V 21/04; F21V 21/15; F21V 23/0435; F21V 29/773; F21S 8/026

See application file for complete search history.

(56) References Cited

U.S. PATENT DOCUMENTS 6,036,337 A * 3/2000 Belfer ..... F21S 8/02 362/257

6,652,124 B2 * 11/2003 Schubert ..... F21S 8/02 362/148

(Continued)

*Primary Examiner* — Zheng Song

(57) ABSTRACT

A motorized recessed spotlight includes a light unit which has, arranged inside, electrical power supply devices and a light beam emission source, a base, and a mechanical support unit having a ring lying in a plane and provided with a radial recess open in the vertical direction. At least one second motor extends parallel to a vertical axis of rotation and is fastened to a support unit. The spotlight further includes a cylindrical pinion with a longitudinal axis and radial teeth, coaxial with shaft of the second motor and keyed thereon, and a rack with a curved profile and of suitable length. The second motor, pinion, rack and support unit cause a tilting movement of the light unit about the longitudinal axis so as to maintain a constant breadth of the light beam emitted in any angular position of the spotlight.

10 Claims, 5 Drawing Sheets

(56) References Cited

U.S. PATENT DOCUMENTS

Figure 1:
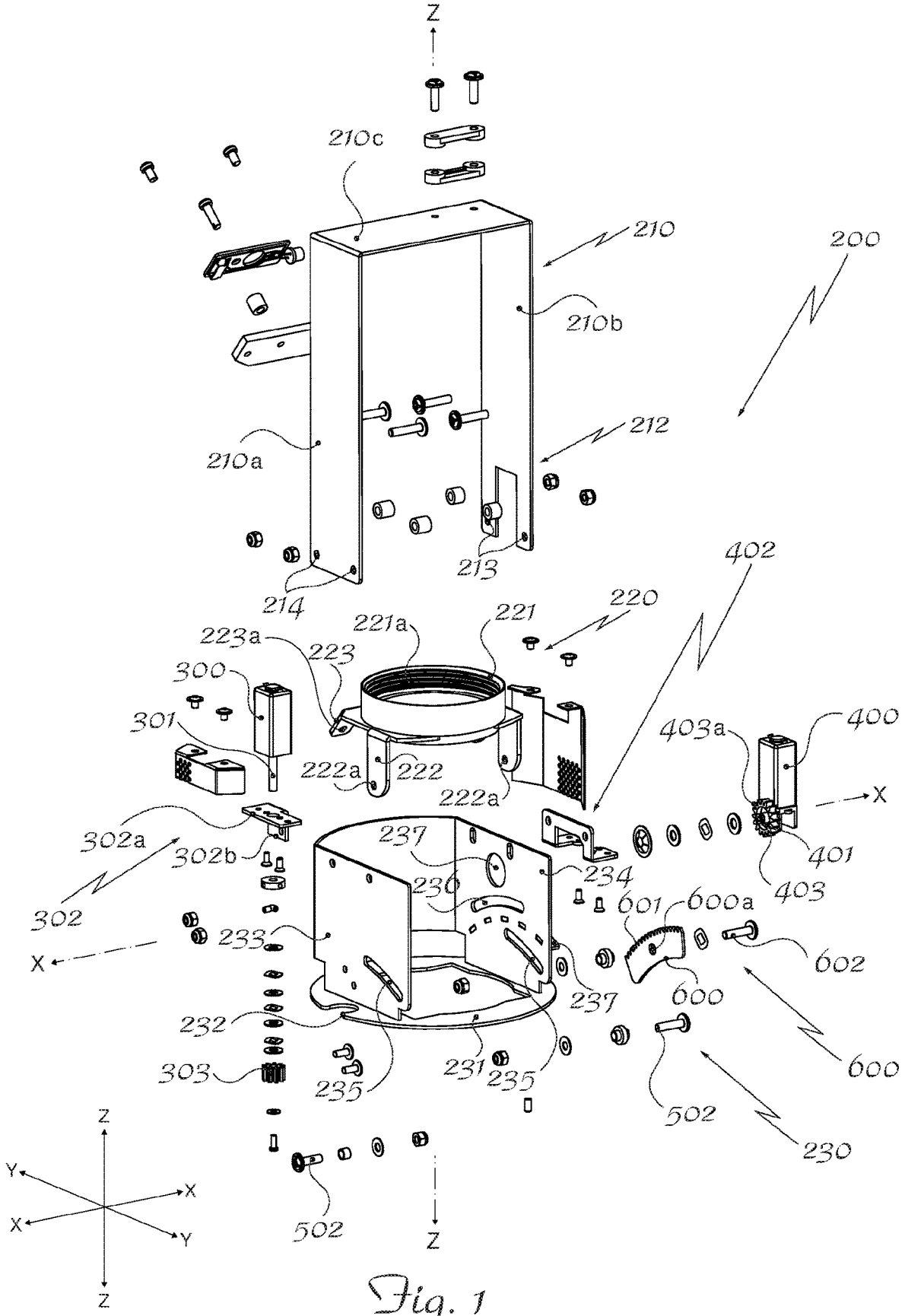

| | | | | |
|---|---|---|---|---|
| 7,484,866 | B1 * | 2/2009 | Buse | F21S 8/02 362/147 |
| 7,625,105 | B1 * | 12/2009 | Johnson | F21S 8/02 362/147 |
| 10,012,369 | B1 * | 7/2018 | Wang | F21V 21/15 |
| 2010/0165643 | A1 * | 7/2010 | Russo | F21V 21/04 362/365 |
| 2010/0165646 | A1 * | 7/2010 | Russo | F21S 8/02 362/430 |
| 2015/0219331 | A1 * | 8/2015 | Clark | F21V 29/71 362/364 |
| 2015/0241038 | A1 * | 8/2015 | Fryzek | F21S 8/026 362/147 |
| 2018/0073705 | A1 * | 3/2018 | Delano | F21V 7/00 |
| 2020/0348001 | A1 * | 11/2020 | Spicer | F21V 21/048 |

* cited by examiner

MOTORIZED RECESSED SPOTLIGHT WITH RACK FOR ROTATION ABOUT A LONGITUDINAL AXIS

CROSS-REFERENCE TO RELATED APPLICATIONS

The present application is a national stage application of international application no. PCT/IB2019/051974, filed on Mar. 12, 2019, which claims priority to Italian patent application no. 102018000003612, filed on Mar. 15, 2018.

BACKGROUND OF THE INVENTION

The present invention relates to a motorized recessed spotlight for rotation about a longitudinal axis.

Various types of motorized recessed spotlight controlled by means of a remote control are known in the technical sector of lighting.

These characteristics are particularly useful in commercial premises, museums or hospitals, where frequent variations in the environment and/or surrounding conditions require adaptation of the direction of the light beam emitted by the spotlight.

It is, however, also known that it is increasingly required that these spotlights should have small dimensions so that the light beam, and not the spotlight body, may be amplified, while at the same time remaining aesthetically pleasing.

Such a feature, however, is basically incompatible with the need to provide the spotlight with movement means which are able to allow rotations about at least one axis, and preferably several axes, but which at the same time cannot be seen by the user during use.

A further effect which is also required is that the light beam should not be subject to limitations in its breadth due to the variation in the angular direction of the spotlight. US 2017/227201 A1 describes an example of a spotlight with a motor for rotation of the spotlight about a longitudinal axis, in which the rotational movement results in partial shielding (with a consequent limitation of the breadth) of the light beam emitted by the spotlight.

Further examples of known spotlights are described in CN 201 983 137, US 2014/268836, 2017/292687 and CN 106 989 326.

SUMMARY OF THE INVENTION

The technical problem which is posed therefore is that of providing a recessed spotlight able to rotate about at least one axis, preferably two axes perpendicular to each other, and that of limiting the dimensions of the drive system to dimensions such that they may be contained within the spotlight and preferably are invisible from the exterior, without reducing the breadth of the light beam when there is a variation in the direction of the spotlight.

In connection with this problem it is also required that such a spotlight should be easy and inexpensive to produce and assemble and be able to be easily installed at any user location using normal standardized connection means.

These results are obtained according to the present invention by a motorized recessed spotlight for rotation about a longitudinal axis according to the characteristic features of Claim 1. With this spotlight structure, in fact, it is possible to vary the orientation of the light unit by operating the associated tilting motor without this resulting in a variation of the breadth of the light beam emitted by the spotlight and while concealing from sight the drive system of the spotlight itself.

DETAILED DESCRIPTION OF THE SEVERAL VIEWS OF THE DRAWINGS

Figure 2:
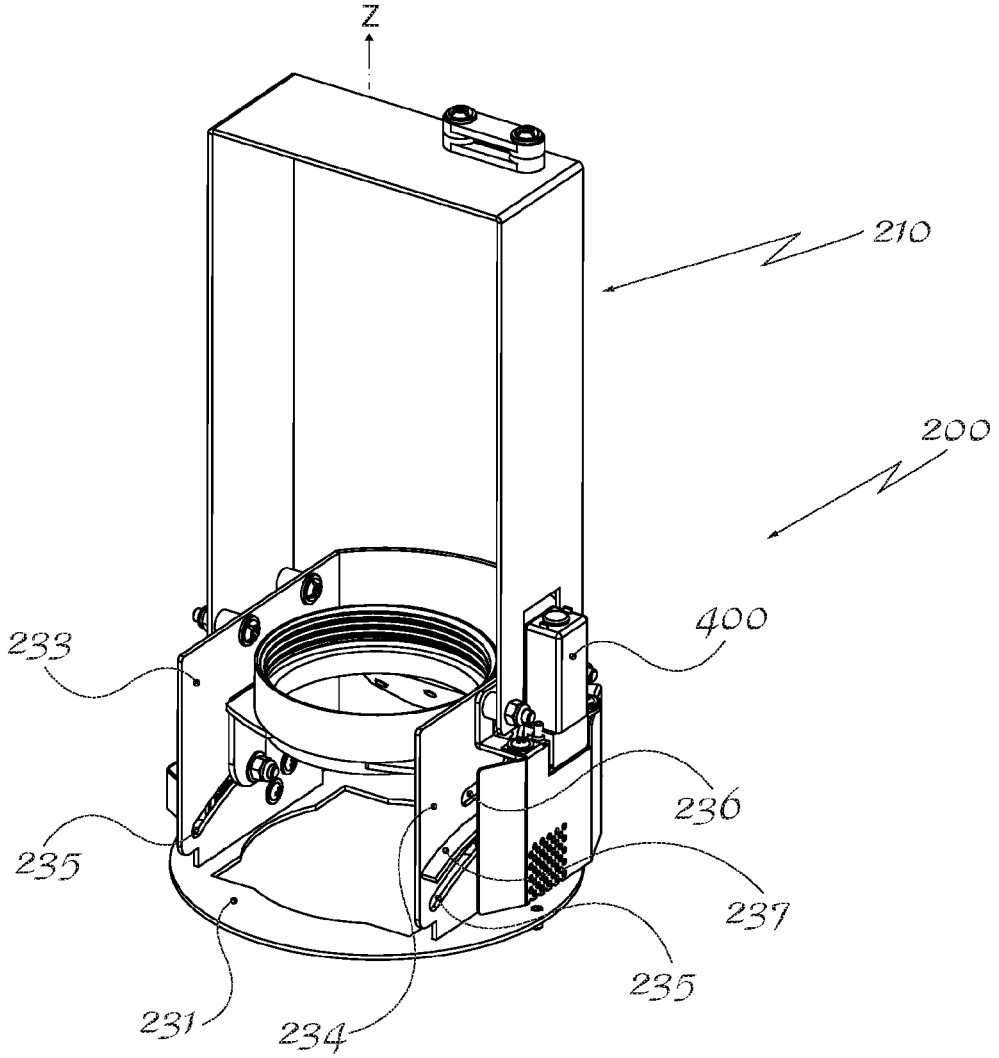
Figure 2:
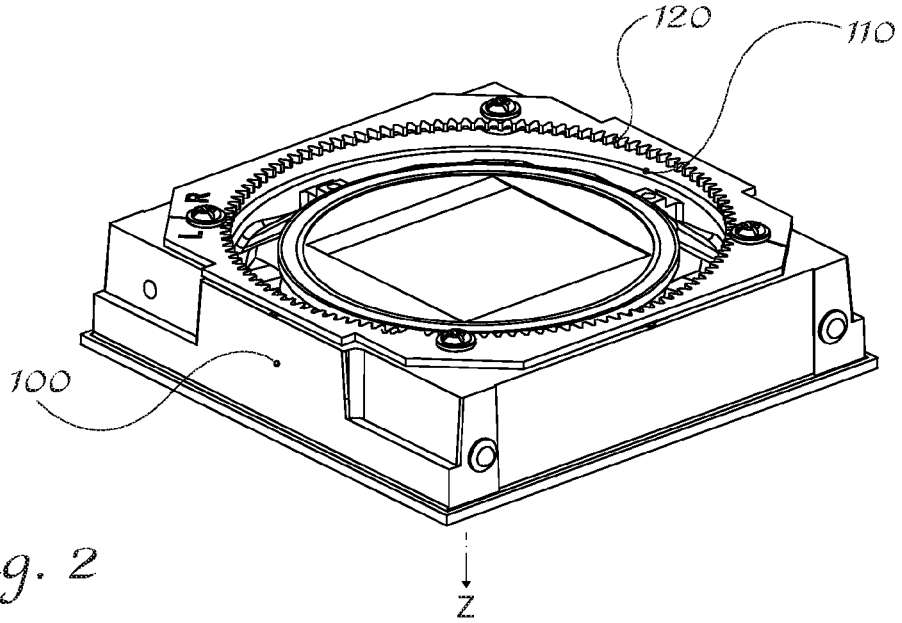
Figure 3:
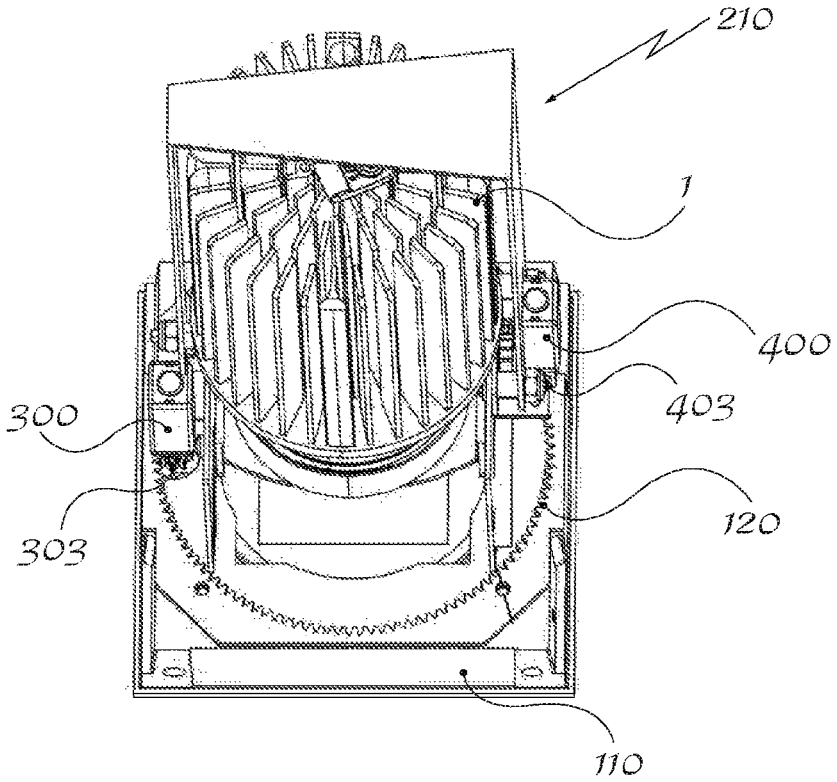
Figure 4:
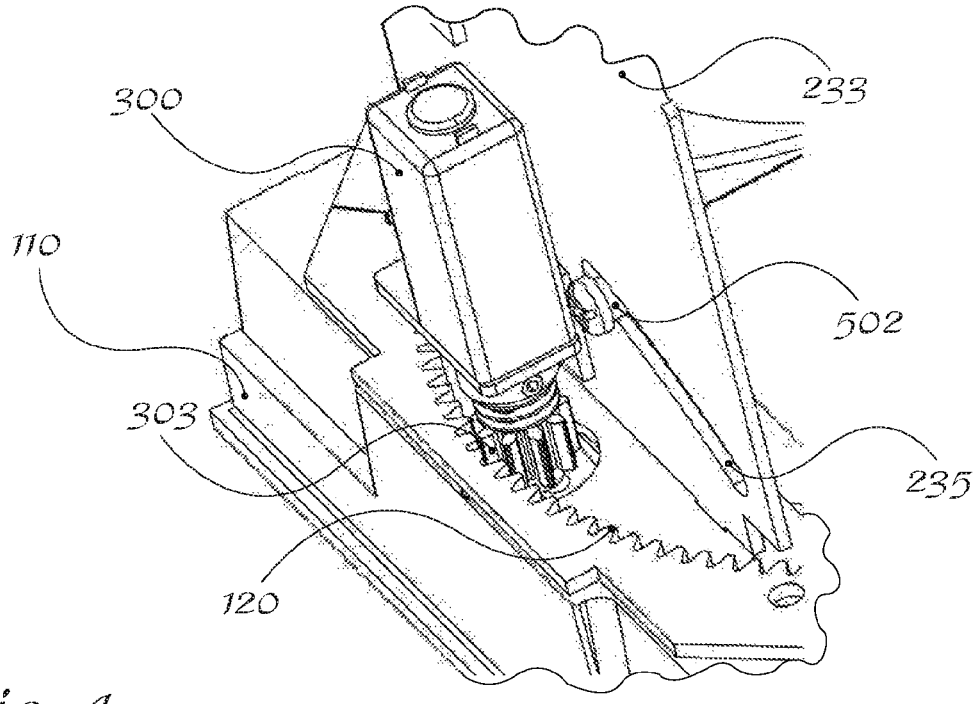
Figure 5:
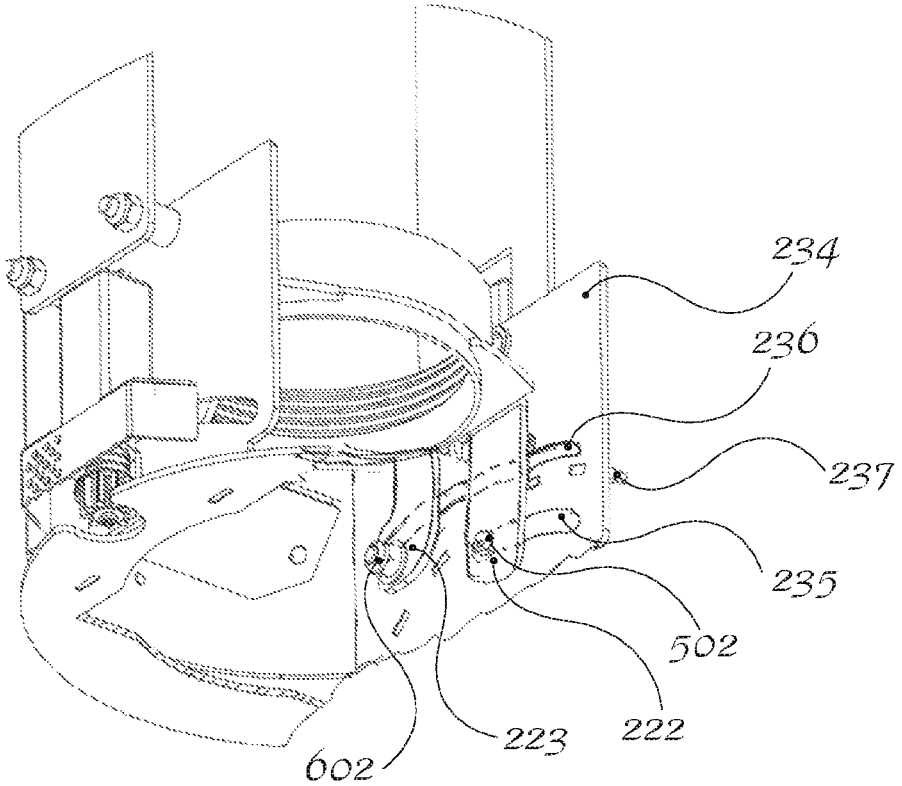
Figure 6:
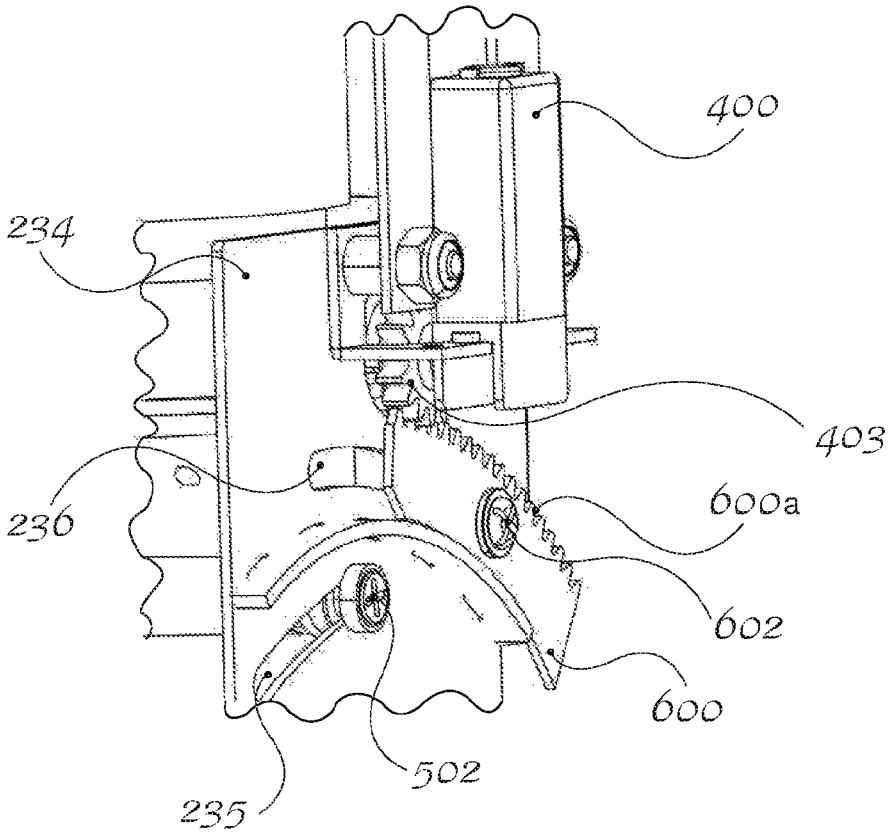
Figure 7:
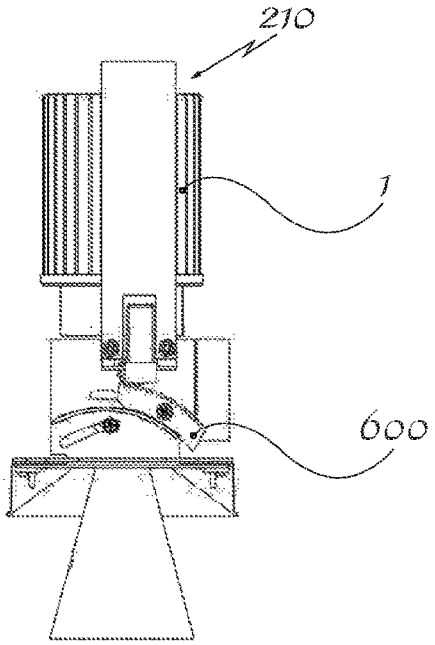
Figure 8:
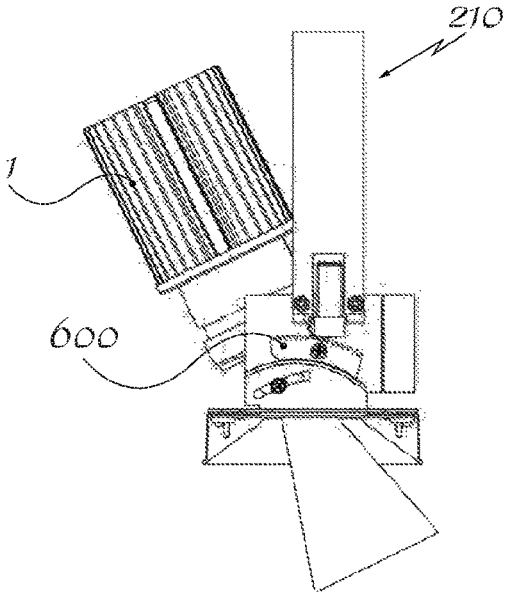
Figure 9:
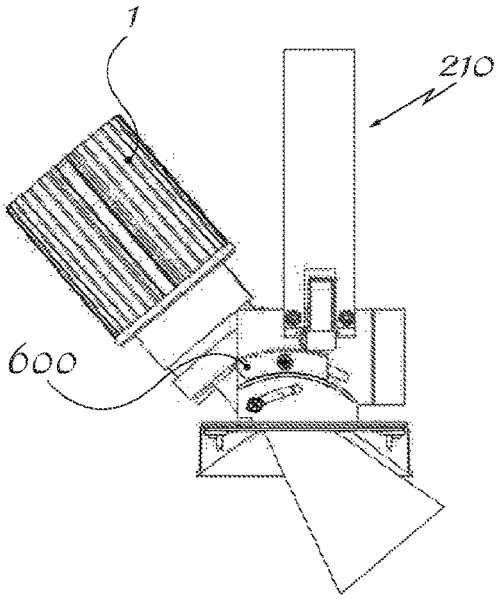

Further details may be obtained from the following description of a non-limiting example of embodiment of the subject of the present invention provided with reference to the attached drawings in which:

FIG. 1: shows a partial exploded perspective view of a spotlight according to the present invention;

FIG. 2: shows a perspective view of the spotlight according to the present invention, in a partially assembled condition;

FIG. 3: shows a perspective view of the spotlight according to FIG. 2 in the assembled condition;

FIG. 4: shows a partial perspective view of the detail of the means for rotational control about a vertical axis;

FIG. 5: shows a partial perspective view of the spotlight according to FIG. 2 from the inside;

FIG. 6: shows a partial perspective view of the detail of the means for rotational control about a longitudinal axis; and FIGS. 7-9: shows partially sectioned perspective view of the spotlight and the associated light beam during the different angular rotations about a longitudinal axis.

DETAILED DESCRIPTION OF THE INVENTION

For greater clarity, the details which are conventional per se, such as electrical wiring and fixing elements, have been excluded from the figures.

As shown in FIG. 1, solely for the sake of easier description and without a limiting meaning, a set of three reference axes have been assumed, i.e. in a longitudinal direction X-X, corresponding to the widthwise dimension of the spotlight; in a transverse direction Y-Y, corresponding to the depthwise dimension of the spotlight; and in a vertical direction Z-Z, at right angles to the other two directions; for easier description and with reference to the orientation shown in the figures, the longitudinal axis X-X is arranged coinciding with a first, horizontal, axis of rotation and the axis Z-Z is arranged coinciding with a second, vertical, axis of rotation.

As shown, a motorized recessed spotlight according to the invention comprises essentially:

- a unit 1 (FIG. 3) having, arranged inside it, the electrical power supply devices and the source for emission of the light beam, these being components which are conventional per se and therefore are not further described;
- a base 100, with a form which is only preferably square-shaped, as in the example shown, and which has an inset seat 110 for housing an annular rack 120 fixed to the said base;
- a mechanical support unit (200) comprising:
  - a ferrule 220 comprising a cylindrical part 221 provided with a female thread 221 for engagement with the light unit 1; at least two first tongues 222 extending parallel to the vertical direction Z-Z and provided with a respective through-hole 222*a* in the longitudinal direction X-X;

at least one third tongue 223 extending parallel to the vertical direction Z-Z and provided with a respective through-hole 222*a* in the longitudinal direction X-X, said third tongue 223 being arranged at a suitable angular distance in the plane X-Y from either one of the two first tongues 222;

a support 230 comprising a ring 231 lying in a plane X-Y and provided with a radial recess 232 open in the vertical direction; at least a first wall 233 and a second wall 234 lying parallel to each other in a respective plane Y-Z, arranged facing each other in the longitudinal direction X-X and being fixed to the ring 231;

preferably the two walls 233,234 are connected by a third reinforcing wall 235 extending in a plane X-Y and fixed to one side of the two opposite walls 233,234.

Each wall 233,234 has a respective first eyelet 235 with a curved profile of predefined length open in the longitudinal direction X-X;

only the second wall 234 has a second eyelet 236 with a curved profile of predefined length open in the longitudinal direction X-X as well as a through-hole 237 in turn formed in the longitudinal direction X-X;

a first optional motor 300, the shaft 301 of which extends parallel to the vertical axis of rotation Z-Z of the spotlight; the motor is mounted on a first bracket 302 in the form of an overturned L which has a surface 302*a* in the longitudinal surface X-Y and a surface 302*b* in the vertical direction Y-Z; both the surfaces are respectively provided with through-holes for allowing the shaft 301 of the motor 300 to pass through and fixing to the first wall 233 of the support 200 and, if present, to a frame 219 described further below;

a cylindrical gear 303 which is coaxial with the shaft 301 arranged on the opposite side of the longitudinal surface 302*a* of the bracket 302 to the motor 300 and on which the said shaft 301 is fixed; the gear 303 is designed to engage with the teeth 120 of the rack 110 so as to cause rotation of the spotlight about the vertical axis Z-Z, as will become clearer below;

a second motor 400 which extends preferably parallel to the vertical axis of rotation Z-Z and the shaft 401 of which is driven so as to extend coaxially with the longitudinal axis of rotation X-X; the motor is mounted on a second bracket 402 in the form of an overturned L which has a surface 402*a* in the transverse direction Y-X and a surface 402*b* in the vertical direction X-Z; both the surfaces are provided respectively with through-holes for allowing the shaft 401 of the motor 400 to pass through and fixing to the second wall 234 of the support 200 and, if present, to a frame 210 described further below;

a cylindrical pinion 403 with longitudinal axis X-X and radial teeth 403*a*, coaxial with the shaft 401 keyed onto the said pinion;

a rack 600 with curved profile and of suitable length provided with teeth 601; the rack has a through-hole 600*a* with a longitudinal axis X-X for receiving a pin 602 designed to pass through the second eyelet 236 for fixing the rack to the second wall 234 of the support 230; the pin may slide freely inside the second eyelet between the two opposite ends thereof;

a shoulder 237 projecting towards the outside from the second wall 234, provided with a curved profile corresponding to that of the rack 600 and arranged so that the side of the rack opposite to that of the teeth may rest on the said shoulder.

When assembly has been performed:

the ferrule 220 has a first tongue and second tongue 222 connected to the respective pin 502 inserted into the corresponding eyelet 235 of the opposite first wall 233 and second wall 234;

the third tongue 213 is connected to the pin 602 of the rack 600 inserted through the second eyelet 236 of the second wall 234 of the support 200;

the cylindrical gear 303 with vertical axis Z-Z of the first motor 300 engages with the teeth 120 of the rack 110;

the pinion 403 with teeth 403*a* meshes with the teeth 601 of the rack 600;

the light unit 1 is screwed into the female thread 221 of the ferrule 220.

With this configuration and once the various functional parts have been assembled, the operating principle of the spotlight is as follows:

powering of the first motor 300 (FIG. 4) causes rotation of the gear 303 which, actuating the fixed rack 120, causes the rotation of the spotlight and therefore the light unit 1 about the vertical axis Z-Z with respect to the base 100; during rotation the second motor 400 fixed to the support is also driven;

powering of the second motor 400 (FIGS. 7-9) causes rotation of the pinion 403, the teeth 403*a* of which cooperate with the teeth 600*a* of the rack 600, forcing the pin 602 thereof to change position inside the second eyelet 236:

from an end position (FIG. 7) corresponding to a position of the light unit 1 and therefore the axis of the light beam emitted, parallel to the axis of rotation Z-Z:

to intermediate positions (FIG. 8) where the light beam is inclined with respect to the vertical axis of rotation Z-Z;

to an end position opposite to the preceding position where the light beam is inclined by the maximum permitted angle.

What must be pointed out is that, during the movement of the pin 602 along the curved profile of the eyelet 235, the rack 600 also moves parallel to the said eyelet while resting against the shoulder 237 and the pin 602 moves, along with it, the third tongue 223, forcing the light unit to perform a tilting movement resulting from its rotation about the pins 502 fixed to the first tongues 222 and a translational movement caused by the movement of the rack 600; the tilting action has an overall effect (see FIGS. 7-9) such that the light beam always remains fully formed, without being partially obscured by the structure of the spotlight.

Powering in succession of the two motors 300,400 therefore results in orientation of the light beam with different positive or negative angles with respect to the vertical axis Z-Z and/or different angular orientations in the horizontal plane X-Y, with the light beam remaining always fully formed.

According to preferred embodiments it is envisaged that the spotlight comprises:

a frame 210 in the form of a bridge comprising two vertical uprights 210*a*,210*b* connected at the opposite top ends by a longitudinal cross-piece 210*c;* the free end of one upright—the upright 210*b* in FIG. 1—of the two uprights of the frame 210 has a fork 212, the arms 212*a* of which situated opposite each other in the transverse direction Y-Y have a respective hole 213 pass through them in the longitudinal direction X-X; similarly the other arm 210*a* has a free end provided with respective holes 214 passing through it in the longitudinal direction X-X; and/or electronic means (not shown) for receiving radio signals emitted remotely by means of a remote control and designed to control operation of the motors 300,400, so as to allow the user to vary easily the direction of the light beam without having to physically access the spotlight; and/or a sliding friction means, not shown, arranged between the two drive shafts 301,401 and the support 230 in order to prevent damage to the motors in the event of forced manual operation by the user.

Although described in relation to a configuration shown, comprising two drive units for two separate rotational movements, it is understood that the person skilled in the art may realize the spotlight with only one of the said two drive units and in particular that for performing only rotation with tilting about the longitudinal axis X-X.

It is therefore clear how, as a result of the particular configuration of the spotlight according to the invention, it is possible to operate the light unit along at least one and preferably two different axes of rotation, while limiting the size of the drive unit to dimensions such that they remain within the spotlight and are invisible from the outside, even in the case of small-size spotlights.

The spotlight is also formed by parts which are easy and inexpensive to produce and assemble and which may be easily installed at any user location using normal standardized connection means.

Although described in connection with a number of embodiments and a number of preferred examples of implementation of the invention, it is understood that the scope of protection of the present patent is determined solely by the claims below.

The invention claimed is:

1. A motorized recessed spotlight comprising:

a light unit inside which an electrical power supply device and a light beam emission source are arranged;

at least a vertical axis (Z-Z);

a base;

a mechanical support unit comprising:

a ferrule comprising a cylindrical part provided with a female thread for engagement with the light unit;

at least two first tongues extending parallel to a vertical direction (Z-Z) and provided with a respective through-hole in a longitudinal direction (X-X);

at least one third tongue extending parallel to the vertical direction (Z-Z) and provided with a respective through-hole in the longitudinal direction (X-X), said third tongue being arranged at a suitable angular distance in a plane (X-Y) from either one of the two first tongues;

a ring lying in the plane (X-Y) and provided with a radial recess open in the vertical direction (Z-Z);

at least one first wall and one second wall lying parallel to each other in a respective plane (Y-Z), arranged facing each other in the longitudinal direction (X-X) and being fixed to the ring; each wall having a respective first eyelet with a curved profile of predefined length open in the longitudinal direction (X-X); the second wall having a second eyelet with a curved profile of predefined length open in the longitudinal direction (X-X) as well as a through-hole in turn formed in the longitudinal direction (X-X);

at least one motor for tilting the light unit, fastened to the second wall of the support unit and provided with a shaft;

a cylindrical pinion with the longitudinal axis (X-X) and radial teeth, coaxial with the shaft of the motor for tilting the light unit and keyed thereon;

a rack with curved profile and of suitable length provided with teeth; the rack having a through-hole with the longitudinal axis (X-X) for receiving a pin designed to pass through the second eyelet for fixing the rack to the second wall;

wherein the pin is arranged to slide freely inside the second eyelet between the two opposite ends thereof; said motor, pinion, rack and support unit being thereby arranged to cause a tilting movement of the light unit about the longitudinal axis (X-X) so as to maintain a constant breadth of a light beam emitted in any angular position of the spotlight.

2. The motorized recessed spotlight according to claim 1, wherein said motor for tilting the light unit is mounted on an associated bracket in a form of an overturned "L" which has a surface in a transverse direction (Y-X) and a surface in the vertical direction (X-Z), which are provided with respective through-holes for receiving the shaft of the motor and for performing fixing to the second wall of the support.

3. The motorized recessed spotlight according to claim 1, further comprising a shoulder projecting outwards from the second wall, provided with a curved profile corresponding to that of the rack and arranged so that a side of the rack opposite to that of the teeth rests on said shoulder.

4. The motorized recessed spotlight according to claim 1 wherein said base comprises a vertically recessed seat for housing an annular rack fixed to said base.

5. The motorized recessed spotlight according to claim 4, further comprising a first motor for rotation about the vertical axis (Z-Z), which is fastened to the first wall of the support and the shaft of which extends parallel to the vertical axis of rotation (Z-Z) of the spotlight, said shaft being keyed onto a cylindrical gear coaxial with the shaft and designed to mesh with the teeth of the rack so as to cause a rotation of the spotlight about the vertical axis (Z-Z).

6. The motorized recessed spotlight according to claim 5, further comprising a bracket in a form of an overturned "L" for supporting the first motor for rotation about the vertical axis (Z-Z), which has a surface in the longitudinal direction (X-Y) and a surface in the vertical direction (Y-Z), said surfaces being respectively provided with through-holes for receiving the shaft of the motor and for performing fixing to the first wall of the support.

7. The motorized recessed spotlight according to claim 1, further comprising a frame in a form of a bridge comprising two vertical uprights connected at opposite top ends by a longitudinal cross-piece; a free end of one of the two uprights having a fork, arms of which, situated opposite each other in the transverse direction (Y-Y), have a respective through-hole in the longitudinal direction (X-X), the other arm having a free end provided with respective through-holes in the longitudinal direction (X-X).

8. The motorized recessed spotlight according to claim 1, wherein operation of the at least one motor is remotely controllable to vary a direction of the light beam.

9. The motorized recessed spotlight according to claim 1, wherein the motor for tilting the light unit extends parallel to the vertical axis of rotation (Z-Z).

10. The motorized recessed spotlight according to claim 1, the spotlight is configured such that damage is prevented to the at least one motor in an event of forced manual operation by a user.

* * * * *